US009362665B2

(12) United States Patent
Omori et al.

(10) Patent No.: US 9,362,665 B2
(45) Date of Patent: Jun. 7, 2016

(54) JOINT CONNECTOR WITH PAIRS OF LOCKING LANCES AND COMMUNICATION SPACE EXTENDING BETWEEN THE PAIRS OF LOCKING LANCES

(75) Inventors: Yasuo Omori, Yokkaichi (JP); Hidefumi Horiuchi, Yokkaichi (JP); Takamaru Amano, Yokkaichi (JP); Yuji Kitagawa, Osaka (JP); Takashi Tsuchiya, Yokkaichi (JP)

(73) Assignee: AUTONETWORKS TECHNOLOGIES, LTD. (JP)

( * ) Notice: Subject to any disclaimer, the term of this patent is extended or adjusted under 35 U.S.C. 154(b) by 0 days.

(21) Appl. No.: 14/347,896

(22) PCT Filed: Sep. 10, 2012

(86) PCT No.: PCT/JP2012/073126

§ 371 (c)(1),
(2), (4) Date: Mar. 27, 2014

(87) PCT Pub. No.: WO2013/047178

PCT Pub. Date: Apr. 4, 2013

(65) Prior Publication Data

US 2014/0235090 A1 Aug. 21, 2014

(30) Foreign Application Priority Data

Sep. 29, 2011 (JP) ..... 2011-214384
Sep. 29, 2011 (JP) ..... 2011-214386

(51) Int. Cl.
*H01R 13/40* (2006.01)
*H01R 13/627* (2006.01)
(Continued)

(52) U.S. Cl.
CPC ..... *H01R 13/6271* (2013.01); *H01R 4/64* (2013.01); *H01R 13/4223* (2013.01); *H01R 31/085* (2013.01); *H01R 13/501* (2013.01); *H01R 2201/26* (2013.01)

(58) Field of Classification Search
CPC ..... H01R 13/4223; H01R 13/4362
USPC ..... 439/595, 752
See application file for complete search history.

(56) References Cited

U.S. PATENT DOCUMENTS 3,325,769 A * 6/1967 Travis ..... 439/496
4,067,637 A * 1/1978 Narozny ..... 439/634
(Continued)

FOREIGN PATENT DOCUMENTS

JP 2-160385 6/1990
JP 8-250185 9/1996
(Continued)

OTHER PUBLICATIONS

International Search Report of Dec. 5, 2012.

*Primary Examiner* — Hae Moon Hyeon
(74) *Attorney, Agent, or Firm* — Gerald E. Hespos; Michael J. Porco; Matthew T. Hespos

(57) ABSTRACT

A joint connector (10) for electrically connecting a plurality of terminal fittings (20) mounted on ends of a plurality of ground wires (W) of a vehicle includes a pair of terminal holding portions (49A, 49A) for holding a pair of the terminal fittings (20, 20). A pair of locking lances (43, 43) deflectable with respect to each other and configured to suppress the withdrawal of the pair of terminal fittings (20, 20) by locking the pair of terminal fittings (20, 20) are arranged back to back with each other via a deflection permitting space (44) between the pair of terminal holding portions (49A, 49A).

11 Claims, 14 Drawing Sheets

(51) Int. Cl.

| | |
|---|---|
| ***H01R 4/64*** | (2006.01) |
| ***H01R 13/422*** | (2006.01) |
| ***H01R 31/08*** | (2006.01) |
| *H01R 13/50* | (2006.01) |

(56) References Cited

U.S. PATENT DOCUMENTS

| | | | | |
|---|---|---|---|---|
| 5,769,650 | A | 6/1998 | Aoyama et al. | |
| 6,302,735 | B1 | 10/2001 | Nishide et al. | |
| 6,599,150 | B1 * | 7/2003 | Martin et al. | 439/595 |
| 6,648,685 | B2 * | 11/2003 | Nankou | 439/595 |
| 7,381,091 | B2 * | 6/2008 | Menez | 439/595 |
| 7,387,545 | B2 * | 6/2008 | Tyler et al. | 439/752 |
| 7,654,865 | B2 * | 2/2010 | Chazottes et al. | 439/595 |
| 8,025,538 | B2 | 9/2011 | Hara et al. | |
| 8,100,730 | B2 | 1/2012 | Hara et al. | |
| 8,137,116 | B2 | 3/2012 | Omori et al. | |
| 9,028,277 | B2 * | 5/2015 | Nemoto | 439/595 |
| 2002/0102877 | A1 * | 8/2002 | Nankou | 439/595 |
| 2014/0220792 | A1 * | 8/2014 | Omori et al. | 439/34 |

FOREIGN PATENT DOCUMENTS

| | | |
|---|---|---|
| JP | 2000-058181 | 2/2000 |
| JP | 2000-77140 | 3/2000 |
| JP | 2010-40263 | 2/2010 |
| JP | 2011-60522 | 3/2011 |
| JP | 2011-103192 | 5/2011 |
| JP | 2011-103193 | 5/2011 |

* cited by examiner

JOINT CONNECTOR WITH PAIRS OF LOCKING LANCES AND COMMUNICATION SPACE EXTENDING BETWEEN THE PAIRS OF LOCKING LANCES

BACKGROUND

1. Field of the Invention

The present invention relates to a joint connector.

2. Description of the Related Art

Conventionally, a joint connector disclosed in Japanese Unexamined Patent Publication No. 2010-40263 is known as the one to be mounted in a vehicle. This joint connector includes a housing for accommodating female terminals, the female terminals to be connected to male terminals, and a connection conductor to be led out to the outside of the housing and fixed to a body of the vehicle.

The housing includes terminal accommodating chambers arranged in two upper and lower rows and capable of accommodating the female terminals connected to ends of wires, and the terminal accommodating chambers are partitioned by partition walls. A locking lance for retaining the terminal is formed in a cantilever manner on a ceiling wall of each terminal accommodating chamber. When the terminal is inserted into the terminal accommodating chamber, the locking lance is deflected. When the terminal is inserted to a predetermined position, the locking lance is restored and locks and retains the terminal against a force in a direction to withdraw the terminal. Further, since a male fitting portion is inserted into a female electric contact portion of the terminal due to the insertion of the terminal, the terminal and the fitting portion are electrically connected.

In recent years, with a request for the miniaturization of a vehicle, it has been required to miniaturize also a joint connector. Accordingly, if a vertical dimension of the joint connector can be made smaller, the joint connector can be miniaturized. Here, for a locking lance provided on the ceiling wall in each terminal accommodating chamber as disclosed in Japanese Unexamined Patent Publication No. 2010-40263, at least a space for vertical deflection needs to be provided for each terminal accommodating chamber, which has hindered the miniaturization of the joint connector.

The present invention was completed in view of the above situation and aims to miniaturize a joint connector.

SUMMARY OF THE INVENTION

The present invention is directed to a joint connector for electrically connecting a plurality of terminal fittings mounted on ends of a plurality of wires of a vehicle, including a pair of terminal holding portions for holding a pair of the terminal fittings; wherein a pair of locking lances deflectable with respect to each other and configured to suppress the withdrawal of the pair of terminal fittings by locking the pair of terminal fittings are arranged back to back with each other via a deflection permitting space between the pair of terminal holding portions.

According to this configuration, since it is not necessary to secure an individual deflection permitting space corresponding to the amount of deflection of each locking lance by arranging the pair of locking lances back to back with each other via the deflection permitting space, the deflection permitting space required as a whole can be reduced. Thus, the joint connector can be miniaturized.

The following configurations are preferable embodiments of the present invention.

A communication space is formed to allow communication between spaces in the pair of terminal holding portions.

According to this arrangement, since the communication space is formed to allow communication between the spaces in the pair of terminal holding portions, the configuration of the joint connector can be simplified as compared with the case where the pair of terminal holding portions are divided by providing a partition wall or the like in the communication space.

The communication space is provided in projecting directions of the pair of locking lances.

According to this arrangement, the configuration in the projecting directions of the pair of locking lances can be simplified.

The communication space communicates with the deflection permitting space.

According to this arrangement, the configuration of the joint connector can be simplified as compared with the case where the communication space and the deflection permitting space are divided by a partition wall or the like.

An inspection member for inspecting a locking state of the locking lances is insertable into the communication space and the deflection permitting space.

According to this arrangement, the locking state of the locking lances can be inspected by inserting the inspection member into the communication space and the deflection permitting space.

A plurality of holding portion pairs each composed of the pair of terminal holding portions are arranged in parallel, and a communication space for allowing communication between adjacent ones of the deflection permitting spaces is provided between adjacent ones of the plurality of holding portion pairs arranged in parallel.

According to this arrangement, since the communication space for allowing communication between the adjacent deflection permitting spaces is provided, the configuration of the joint connector can be simplified as compared with the case where a partition wall is provided between the adjacent deflection permitting spaces.

The pair of locking lances are provided in a housing, and the housing includes an opening through which an inspection member for inspecting a locking state of the pair of locking lances is insertable and an inspection member insertion space extending from the opening to communicate with the deflection permitting spaces and the communication space.

According to this arrangement, the locking state of the pair of locking lances can be inspected by inserting the inspection member from the opening of the housing up to the deflection permitting space and the communication space through the inspection member insertion space.

The communication space is provided between adjacent ones of all the holding portion pairs.

According to this arrangement, the locking state of the locking lances can be inspected at once for all the terminal fittings by using the inspection member insertable into all the deflection permitting spaces and communication space.

A guide portion is provided to guide a lateral edge part of the inspection member extending in an inserting direction.

According to this arrangement, the inspection member used to inspect the locking state of the locking lances can be easily inserted up to a predetermined position.

The pair of locking lances are provided in a housing, and a breaking groove for breaking the housing is provided on the outer peripheral surface of the housing.

According to this arrangement, the housing can be easily broken by the presence of the breaking groove such as when the wires are removed. Further, by providing the breaking groove in the configuration in which the communication space is provided in the housing as in this configuration, a breaking operation at the breaking groove can be easily performed due to fewer partition walls.

The wires are ground wires and a conductive member electrically connected to the plurality of terminal fittings is mounted on and grounded to a vehicle body.

According to this arrangement, even if the communication space allowing communication between the spaces in the pair of terminal holding portions is provided, it is not necessary to consider dielectric breakdown and the like between the terminal fittings of the ground wires since no voltage is applied. Thus, this arrangement is preferable as an embodiment of the invention.

According to the present invention, it is possible to miniaturize a joint connector.

DETAILED DESCRIPTION OF THE PREFERRED EMBODIMENTS

One embodiment of the present invention is described with reference to FIGS. 1 to 14. A joint connector 10 according to this embodiment is mounted in a vehicle body of an unillustrated vehicle and grounds a plurality of ground wires W (an example of "wires" constituting the present invention). In the following description, a vertical direction is based on FIG. 3, left and right sides of FIG. 3 are respectively referred to as front and rear sides.

Figure 1:
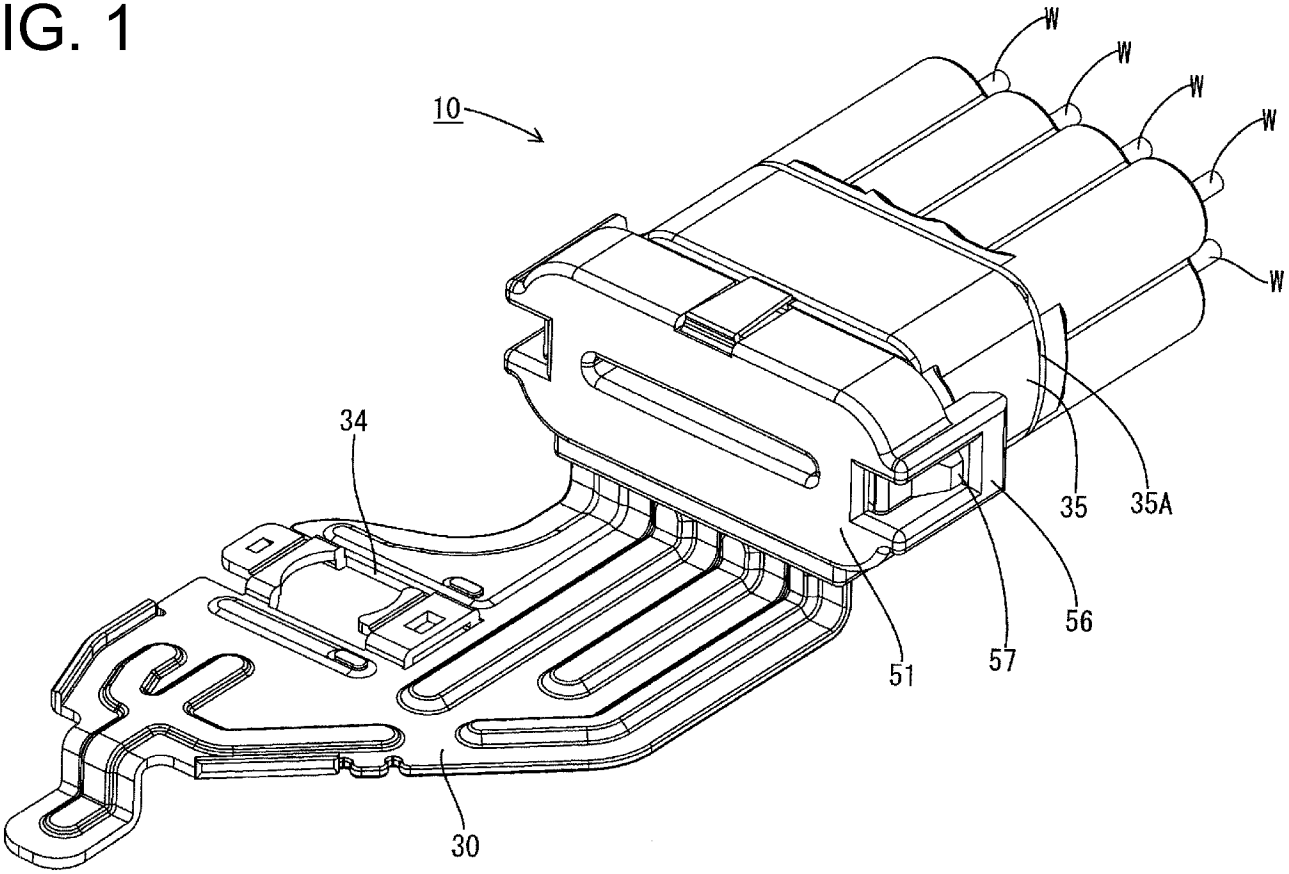
FIG. 1 is a perspective view showing a joint connector of an embodiment according to the present invention.
Figure 2:
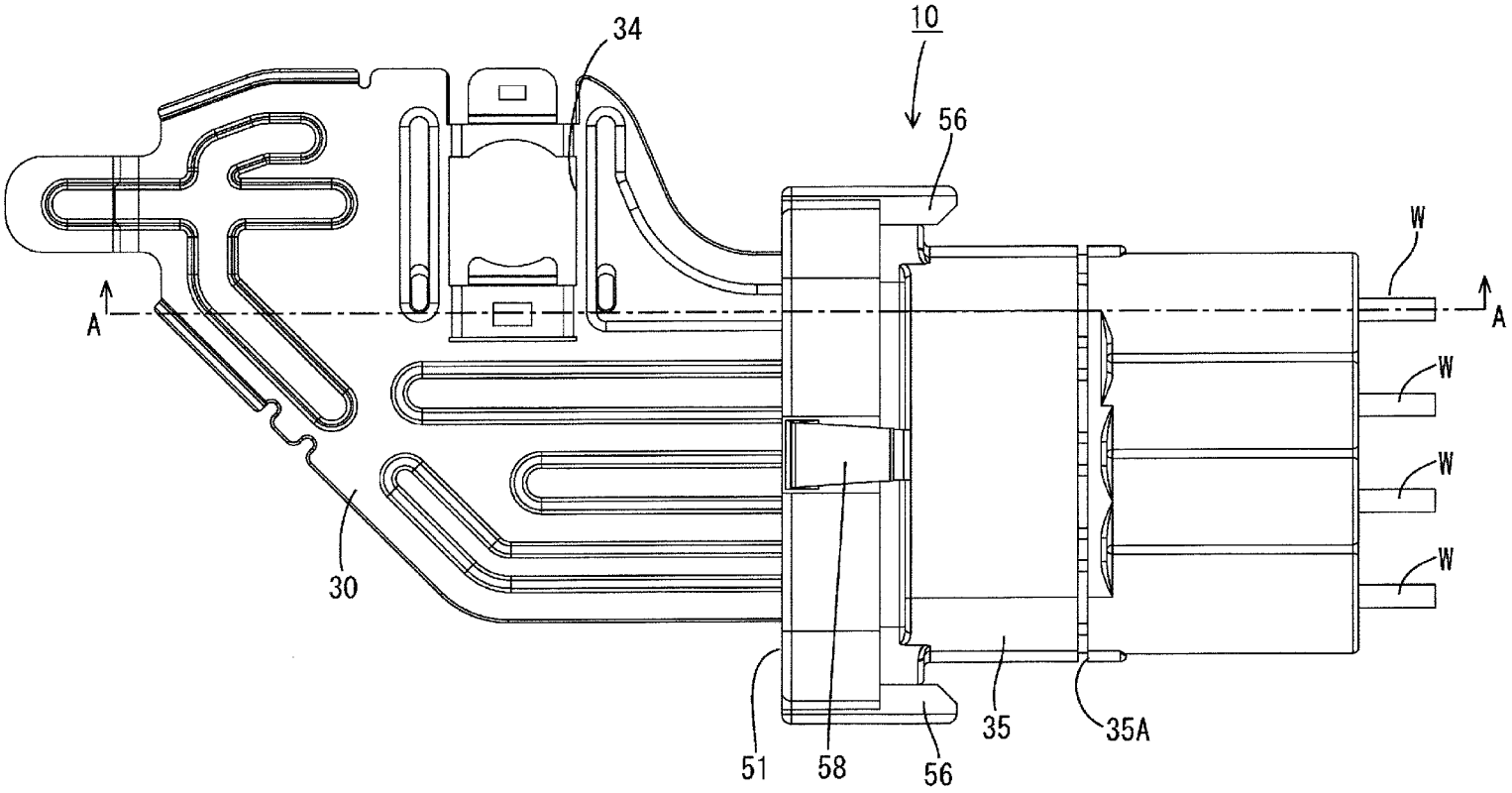
FIG. 2 is a plan view of the joint connector.
Figure 3:
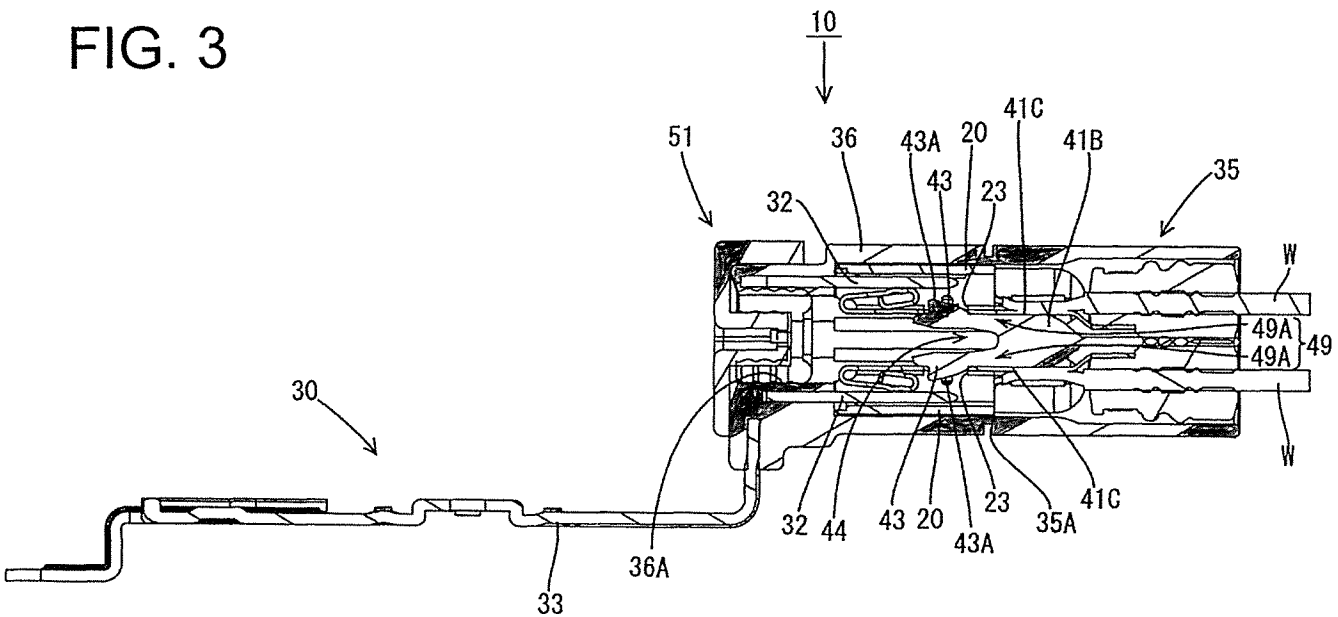
FIG. 3 is a section along A-A showing the joint connector.

The joint connector 10 includes, as shown in FIG. 3, a conductive member 30 made of metal, electrically connected to a plurality of terminal fittings 20 mounted on ends of the respective ground wires W and to be mounted on the vehicle body, and a housing 35 made of synthetic resin and formed by insert-molding a side of this conductive member 30 formed with male tabs 32.

Figure 14:
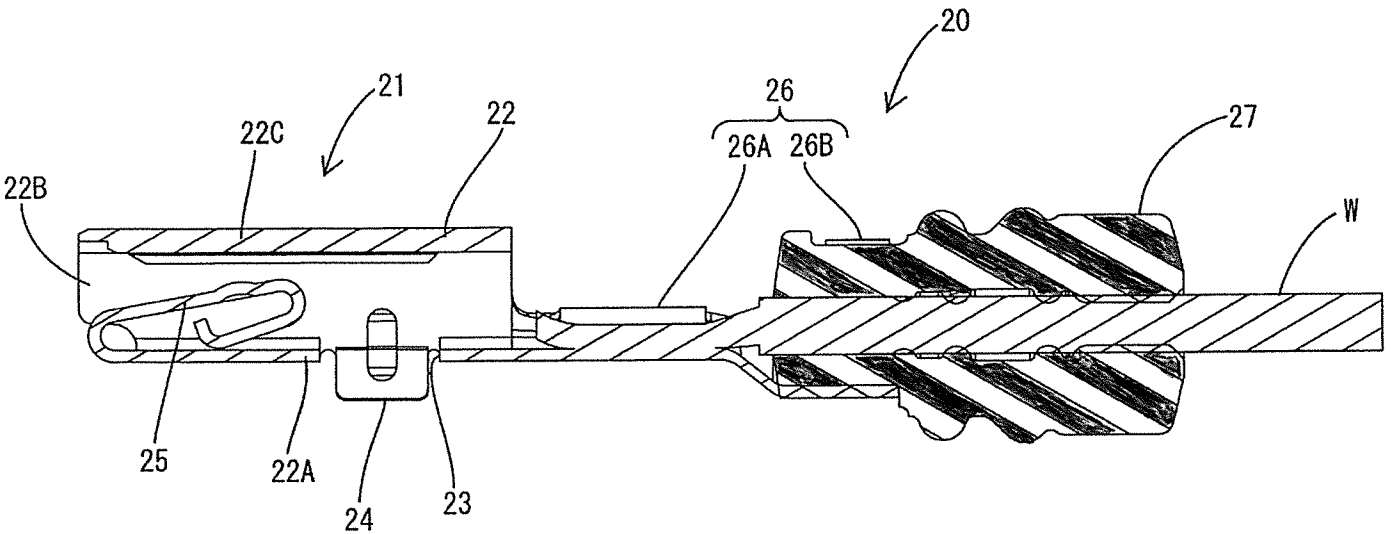
FIG. 14 is a longitudinal section showing the terminal fitting.

The terminal fitting 20 is a female terminal fitting and includes, as shown in FIG. 14, a terminal connecting portion 21 to be connected to the mating male tab 32 and a wire connecting portion 26 connected behind the terminal connecting portion 21 and to be connected to the end of the ground wire W.

The terminal connecting portion 21 includes a resilient contact piece 25 in a tubular portion 22 in the form of a rectangular tube.

The tubular portion 22 is so configured that a bottom wall 22A connected to a base end part of the resilient contact piece 25, a pair of side walls 22B and a facing wall 22C facing the resilient contact piece 25 are annularly connected, and a rectangular locked hole 23 is formed to penetrate through the bottom wall 22A. This locked hole 23 prevents the withdrawal of the terminal fitting 20 by the engagement of a hole edge thereof with a locking lance 43. Plate-like stabilizers 24 for preventing erroneous insertion of the terminal fitting 20 rise at opposite sides of the locked hole 23.

The resilient contact piece 25 is connected to the tip of the bottom wall 22A and folded, and a tip part thereof folded again in the tubular portion 22 can come into contact with the bottom wall 22A.

The wire connecting portion 26 is composed of a wire barrel portion 26A to be crimped to a core part of the wire and a clamping portion 26B provided behind the wire barrel portion 26A and configured to clamp a waterproof rubber plug 27 externally fitted on the ground wire W from above.

A wire in which a conductor part is covered by an insulation coating is used as the ground wire W.

The waterproof rubber plug 27 has a cylindrical shape and is mounted while being held in close contact with the outer periphery of the ground wire W, and a plurality of annularly projecting lips are provided one after another along an axial direction on each of the inner and outer peripheral surfaces of a thick part on a rear side.

The conductive member 30 is formed by press-working a metal plate material into a predetermined shape and insert-molded with the housing 35.

Figure 12:
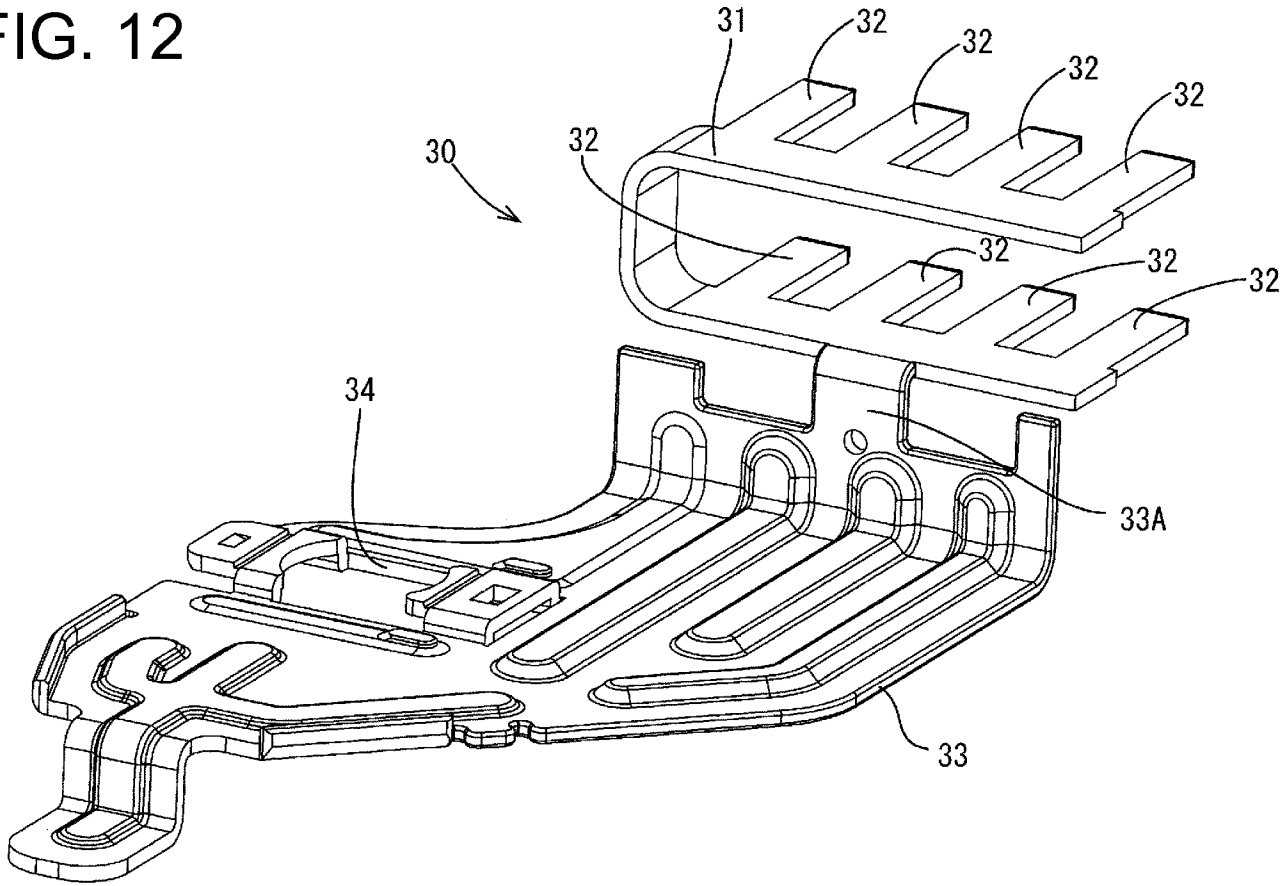
FIG. 12 is a perspective view showing a conductive member.
Figure 13:
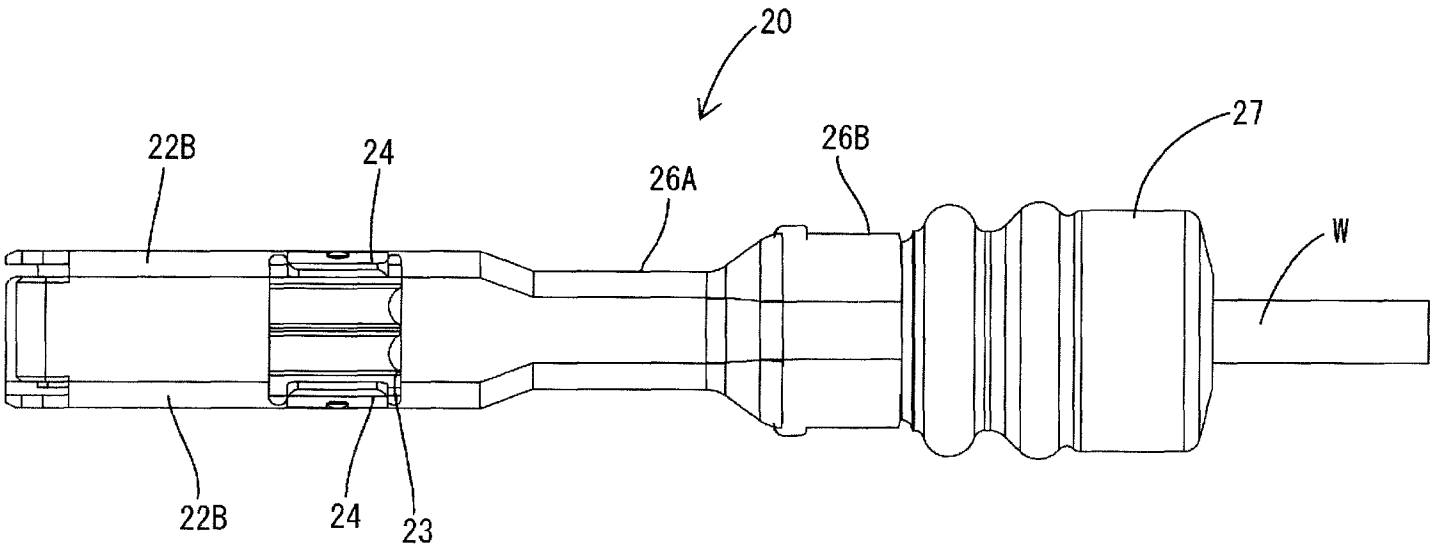
FIG. 13 is a plan view showing the terminal fitting.

As shown in FIG. 12, the conductive member 30 includes a U-shaped tab coupling portion 31, eight (a plurality of) male tabs 32 provided at predetermined intervals in an extending direction of the tab coupling portion 31 and a mounting portion 33 connected below the tab coupling portion 31 and to be mounted on the vehicle body.

The tab coupling portion 31 is formed by curving a strip-like metal plate material.

The male tab 32 is formed into a strip-like shape (rectangular plate) extending in a front-back direction and resiliently comes into contact with the resilient contact piece 25 of the terminal fitting 20 to electrically connect the terminal fitting 20 and the conductive member 30.

The mounting portion 33 extends downward from an intermediate part of a lower row part of the tab coupling portion 31.

The mounting portion 33 includes a narrow portion 33A connected to the lower end of the tab coupling portion 31 and is bent downward at a right angle at a connecting part between the tab coupling portion 31 and the narrow portion 33A and further bent forward at a right angle to extend forward.

A front side of the mounting portion 33 is slightly bent sideways. A mounting hole 34 is formed to penetrate through the mounting portion 33 and an unillustrated bolt is inserted into this mounting hole 34 and threadably engaged with a screw hole (not shown) of the vehicle body, whereby the mounting portion 33 is fixed to the vehicle body.

Figure 7:
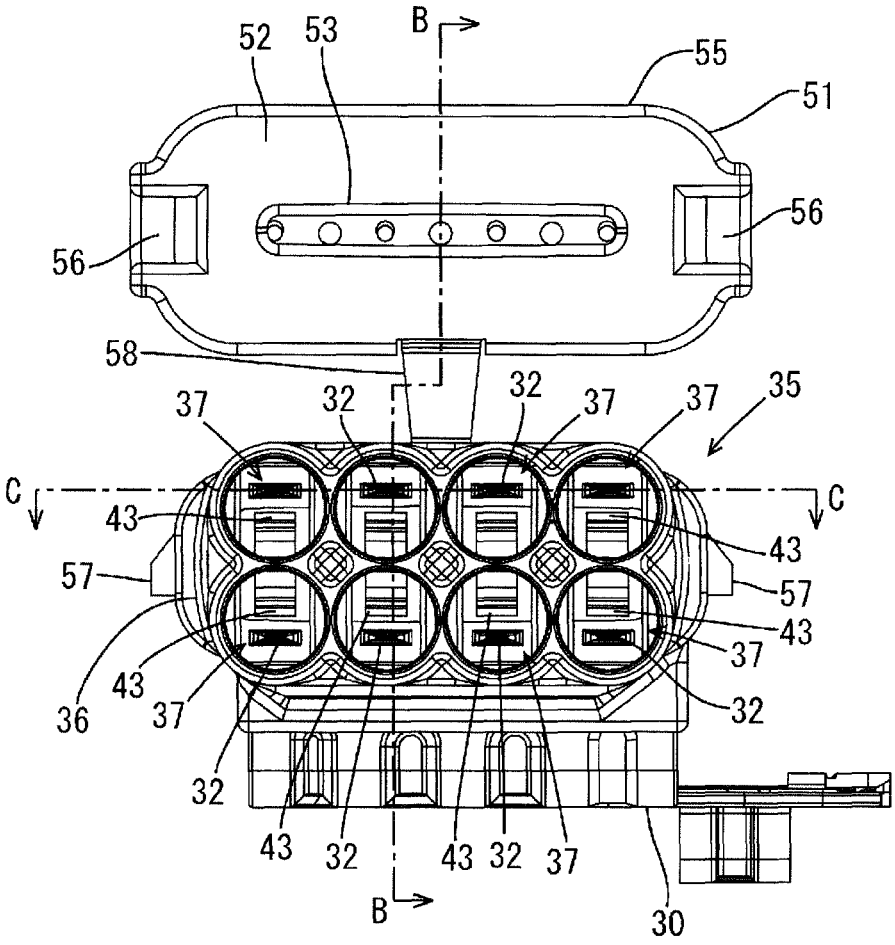
FIG. 7 is a rear view showing the joint connector in the state where the lid portion is opened before the terminal fittings are mounted.

The housing 35 is made of synthetic resin and, as shown in FIG. 7, eight (a plurality of) accommodating chambers 37 for accommodating the terminal fittings 20 connected to the ends of the ground wires W are arranged at equal intervals in two upper and lower rows and four columns in a width direction in a tubular peripheral wall 36 having a laterally long elliptical cross-section.

Figure 8:
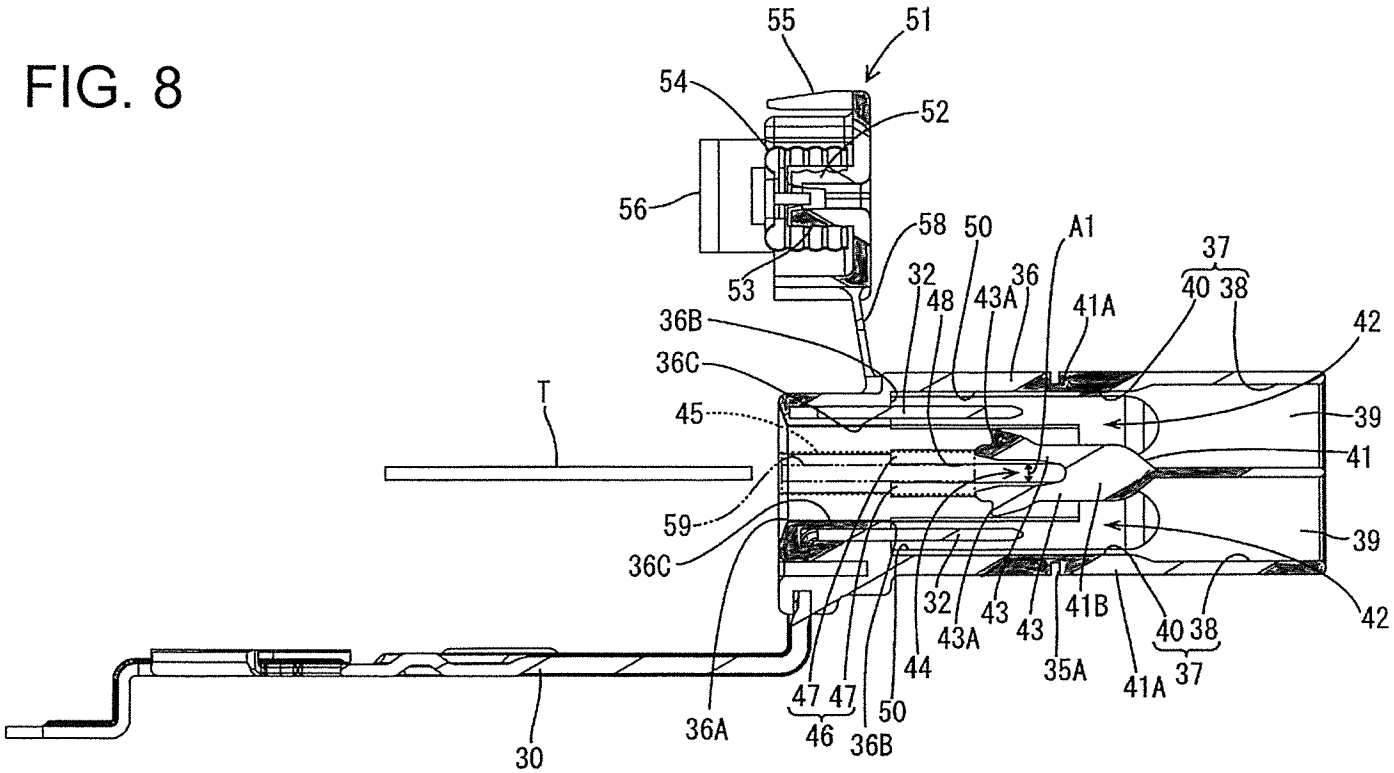
FIG. 8 is a section along B-B of FIG. 7.
Figure 9:
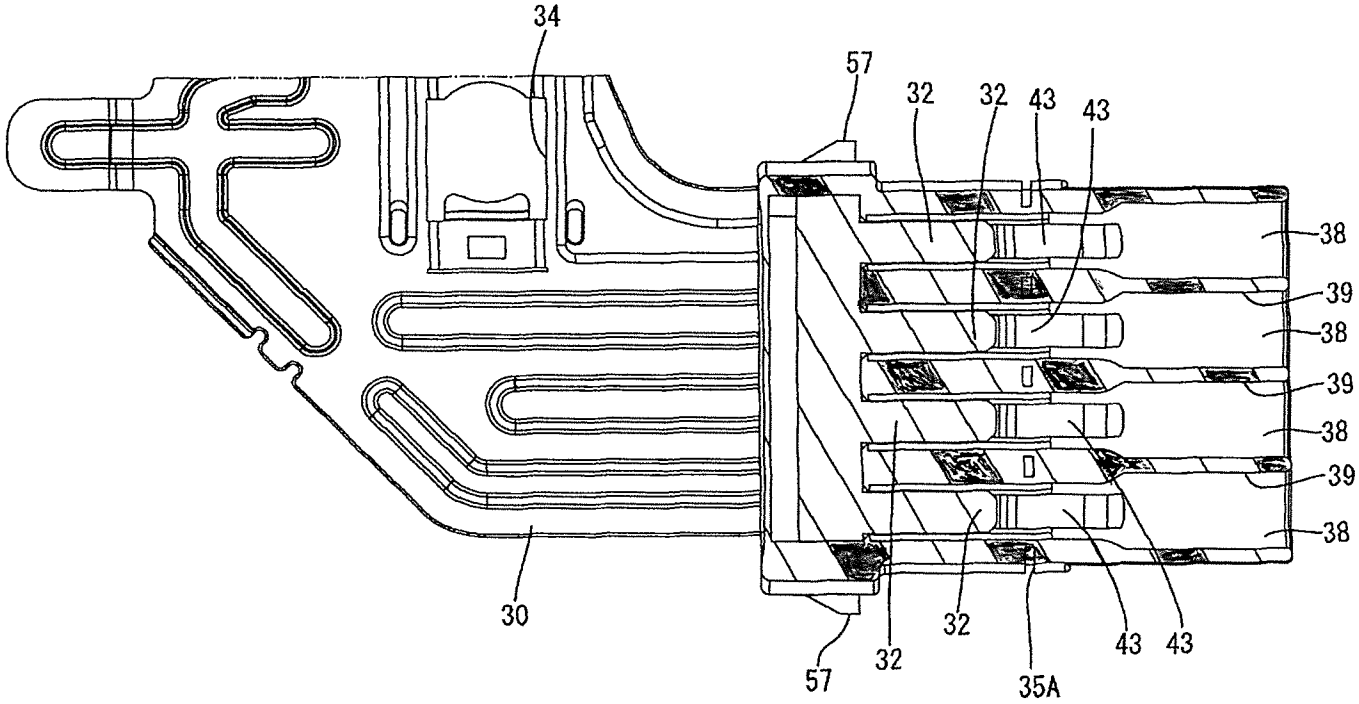
FIG. 9 is a section along C-C of FIG. 7.
Figure 10:
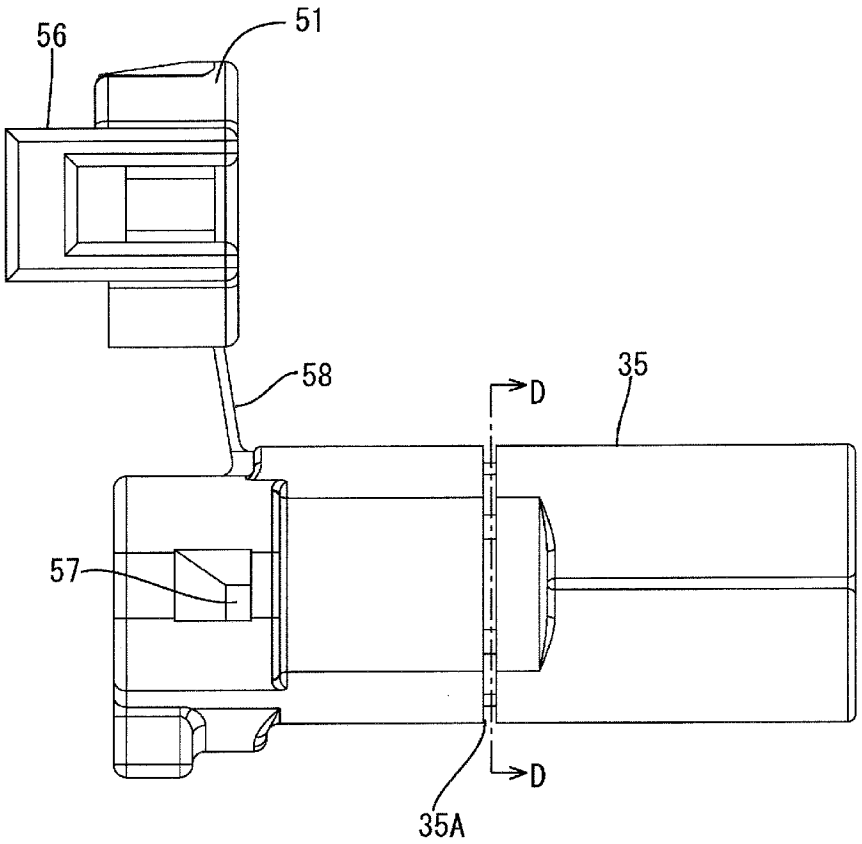
FIG. 10 is a side view showing the joint connector in the state where the lid portion is opened before the terminal fittings are mounted.
Figure 11:
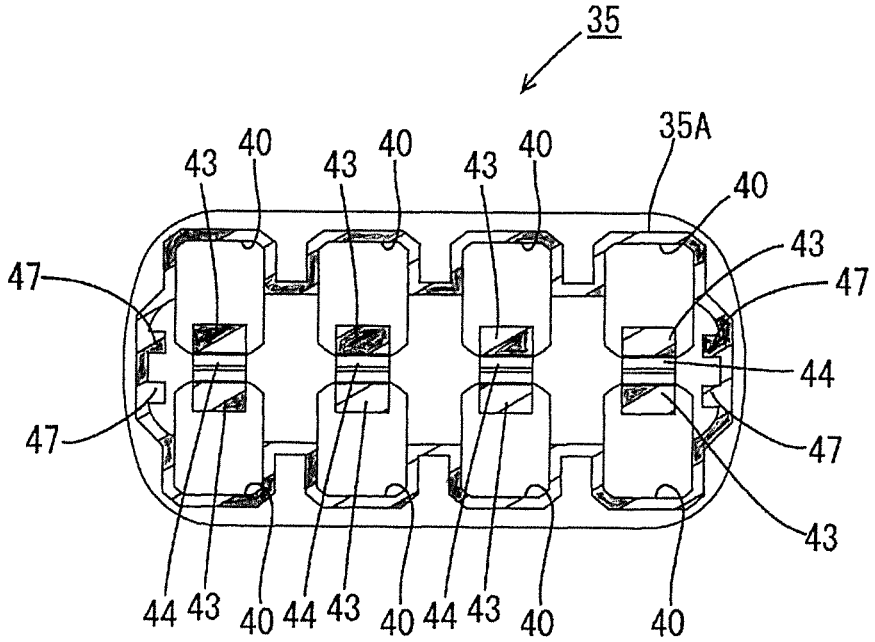
FIG. 11 is a section along D-D of FIG. 10.

(Pairs of) the accommodating chambers 37 in the upper and lower rows are symmetrically provided with respect to a vertical intermediate part and each accommodating chamber 37 includes, in a rear part of the housing 35, a wire accommodating portion 38 for accommodating the ground wire W extending backward from the terminal fitting 20 and a terminal accommodating portion 40 for accommodating a rear side of the terminal fitting 20 before the wire accommodating portion 38 as shown in FIG. 8. Front sides of the terminal accommodating portions 40 (accommodating chambers 37) are formed with no partition walls for division into the respective accommodating chambers 37, and front sides of a plurality of terminal fittings 20 project out into a space in the tubular peripheral wall 36.

The wire accommodating portion 38 is surrounded by a wire-side partition wall 39 having a circumferential inner peripheral surface. The outer periphery of the waterproof rubber plug 27 is held in close contact with the inner surface of this wire-side partition wall 39, thereby providing water-tight sealing between the ground wire W and the wire-side partition wall 39.

The terminal accommodating portion 40 is provided with a terminal-side partition wall 41 connected to the wire-side partition wall 39.

Figure 6:
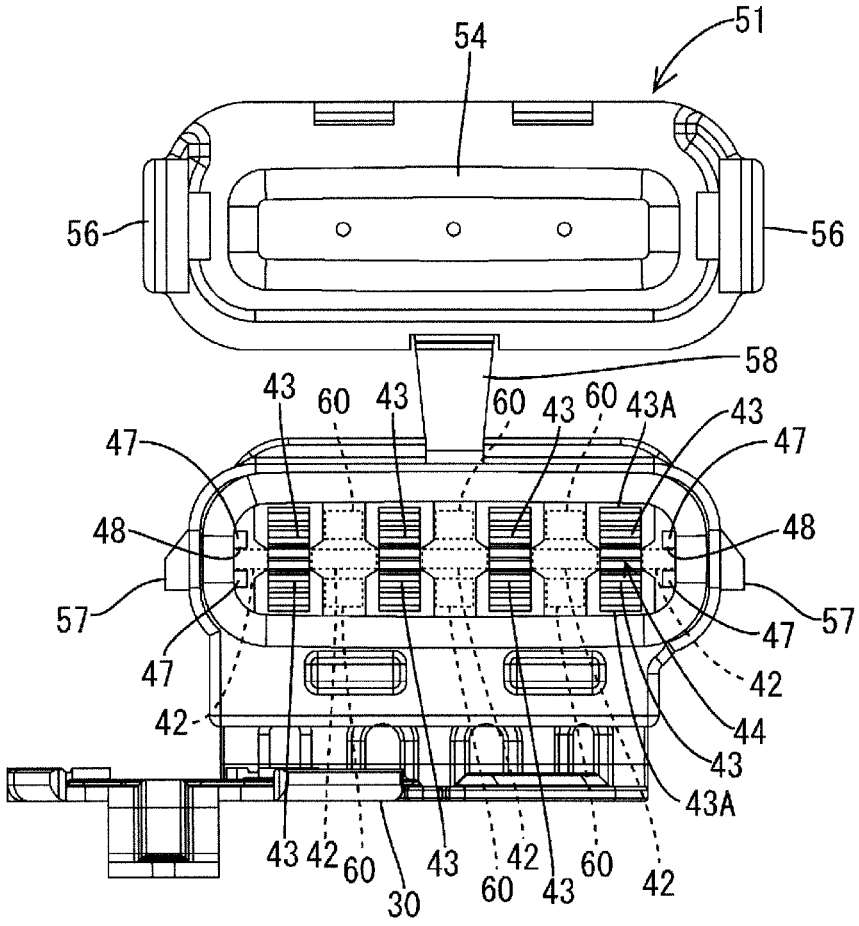
FIG. 6 is a front view showing the joint connector in the state where the lid portion is opened before the terminal fittings are mounted.

The terminal-side partition wall 41 is composed of a ceiling wall 41A shared by the tubular peripheral wall 36 and a bottom wall 41B commonly provided for a pair of accommodating chambers 37 on a vertical middle side, but does not include left and right side walls. Thus, front sides of side walls of the wire-side partition wall 39 are interrupted at a boundary between the wire-side partition wall 39 and the terminal accommodating portion 40. By not forming the side walls for the wire-side partition walls 39, lateral communication spaces 42 (an example of a "communication space" constituting the present invention) allowing communication between deflection permitting spaces 44 for the locking lances 43, 43 are formed for the accommodating chambers 37 laterally adjacent to each other as shown in FIG. 6. The alternately and continuously provided deflection permitting spaces 44 and lateral communication spaces 42 are formed up to inner side surfaces of the tubular peripheral wall 36, and a communication space extending in the entire width of the tubular peripheral wall 36 is formed at a position between the pairs of locking lances 43, 43. Note that an inter-chamber communication space 60 for allowing communication between adjacent accommodating chambers 37 is formed also in a space between the ceiling wall 41A and the bottom wall 41B in each accommodating chamber 37, and a communication space extending in the entire width of the tubular peripheral wall 36 is formed by these inter-chamber communication spaces 60.

A space horizontally extending from the deflection permitting spaces 44 and the lateral communication spaces 42 to an opening 36A on the front end serves as an inspection member insertion space 59 into which a plate-like inspection member T can be inserted up to the rear ends of the deflection permitting spaces 44 and the lateral communication spaces 42 from the opening 36A as shown in FIG. 8.

Figure 4:
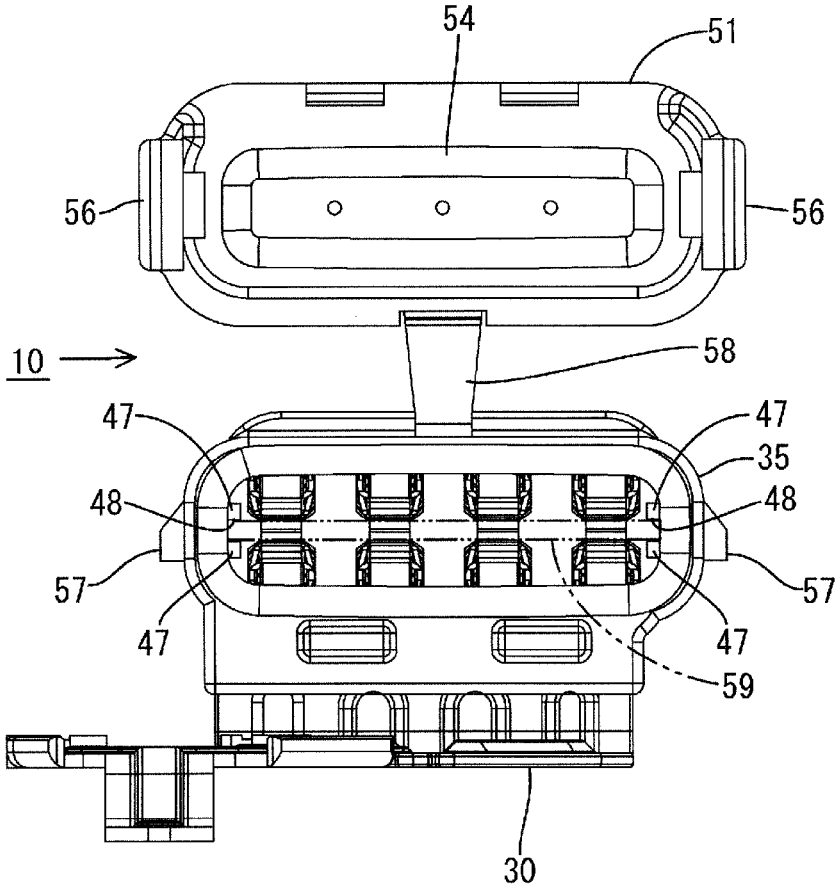
FIG. 4 is a front view showing the joint connector in a state where a lid portion is opened.

The inspection member T is a plate-like member having a width corresponding to a maximum inner diameter of the tubular peripheral wall 36 in the lateral direction (width of the inspection member insertion space 59: see FIG. 4).

When the conductive member 30 is insert-molded with the housing 35, the male tabs 32 are so arranged that tip sides thereof are located in the accommodating chambers 37.

As shown in FIG. 8, the bottom wall 41B is formed to be thicker than the inner wall (bottom wall) of the wire accommodating portion 38, and a pair of upper and lower locking lances 43, 43 are cantilevered forward with this bottom wall 41B as a common base end part.

The locking lances 43, 43 can be vertically deflected, and locking projections 43A for preventing the withdrawal of the terminal fittings 20 by being locked into the locked holes 23 of the terminal fittings 20 are formed on tip sides of the locking lances 43, 43 where the terminal fittings 20 are arranged.

The locking projection 43A projects in a step-like manner and is inclined toward the back to gradually reduce a projecting distance.

A space between a pair of the locking lances 43, 43 serves as the (common) deflection permitting space 44 for permitting deflection of the locking lances 43, 43.

A dimension A1 of this deflection permitting space 44 in the vertical direction (deflection direction) is set to permit deflection of only one locking lance 43. Thus, when the terminal fittings 20 are mounted, a pair of upper and lower terminal fittings 20 are separately mounted without being simultaneously mounted (a plurality of terminal fittings 20 are separately inserted from behind to be locked by the locking lances 43, 43).

By dimensioning the deflection permitting space 44 to permit deflection of only one locking lance 43 in this way, the connector can be miniaturized in the vertical direction as compared with the case where both deflection permitting spaces 44 for the pair of locking lances 43, 43 are dimensioned to permit deflection.

Here, the bottom wall 41B (locking lances 43, 43) is interrupted at a front side (before the locking lances 43, 43) and no bottom wall (partition wall) is provided. By forming no bottom wall (partition wall) before the bottom wall 41B of the terminal accommodating portion 40 in this way, a vertical communication space 45 for allowing communication between spaces in a pair of upper and lower accommodating chambers 37 is formed.

This vertical communication space 45 is so provided before the deflection permitting space 44 as to communicate with the deflection permitting space 44.

The tubular peripheral wall 36 is provided with a step portion 36B having a dimension reduced in a step-like manner and located before the terminal accommodating portions 40, and a diameter-reduced portion 36C where a vertical inner diameter of the tubular peripheral wall 36 is reduced is formed before the step portion 36B. The male tabs 32 project backward (toward the terminal accommodating portions 40) from this step portion 36B.

In this way, on a side of the housing 35 before the terminal accommodating portions 40, the male tabs 20 project into a space corresponding to the inner surface shape of the tubular peripheral wall 36 before the terminal fittings 20 are mounted.

Guide portions 46 for guiding the insertion of the inspection member T for inspecting a locking state of the locking lances 43, 43 are formed on the inner side surfaces of the tubular peripheral wall 36.

Each guide portion 46 is composed of a pair of upper and lower elongated projections 47, 47 arranged in parallel and extending in the front-back direction. Substantially rear halves of the guide portions 46 are formed to be located at both sides of the deflection permitting spaces 44. A width of a groove portion 48 is so dimensioned that the inspection member T can be fitted into and slid in the groove 48. The inspection member T is guided to the deflection permitting spaces 44 by fitting lateral edge parts of the inspection member T extending in an inserting direction into the groove portions 48 of the guide portions 46.

The male tab 32 horizontally extends backward, and an insertion portion 50, into which the facing wall 22C of the tubular portion 22 of the terminal fitting 20 is insertable, is formed between the male tab 32 and the inner surface of the tubular peripheral wall 36.

A vertical clearance of the insertion portion 50 is set to have a constant dimension slight larger than the thickness of the facing wall 22C. This allows the male tab 32 to enter the tubular portion 22 and resiliently come into contact with the resilient contact piece 25 when the terminal fitting 20 mounted on the end of the ground wire W is inserted into the accommodating chamber 37.

At this time, as shown in FIG. 3, the terminal fitting 20 is in such a state where the locking projection 43A is arranged in the locking hole 23 while being held in contact with a surface 41C of the bottom wall 41B. Specifically, the terminal fitting 20 is placed on the surface 41C of the bottom wall 41B and held thereon by being pressed against the surface 41C of the bottom wall 41B by a resilient force of the resilient contact piece 25 in contact with the male tab 32. This causes the terminal fitting 20 to be held only on the male tab 32 and the bottom wall 41B. Even if vibration is applied from the ground wire W or the like, it is absorbed by the resilient force of the resilient contact piece 25, thereby being able to suppress, for example, the breakage of the relatively weak narrow portion 33A of the conductive member 30.

Not that since the terminal fitting 20 is held between the male tab 32 and the bottom wall 41B in this embodiment, the male tab 32 and the bottom wall 41B serve as a terminal holding portion 49A having a function of holding the terminal fitting 20 and a pair of upper and lower terminal holding portions 49A, 49A form a holding portion pair 49.

A breaking groove 35A annually recessed over the entire circumference of the outer peripheral is formed on an intermediate part of the housing 35 in the front-back direction. More specifically, the breaking groove 35A is formed at a position corresponding to rear end parts of the deflection permitting spaces 44 (base end sides of the pairs of the locking lances 43, 43) and parts of the terminal accommodating portions 40 where the side walls are not provided in the front-back direction.

By this, if the ground wires W are strongly pulled, the housing 35 is separated at the position of the breaking groove 35A. This enables the ground wire W side and the conductive member 30 side to be easily divided and an operation of removing the ground wires W from the vehicle body can be simplified.

As shown in FIG. 8, the opening 36A on the front end of the tubular peripheral wall 36 is closed with a lid portion 51.

The lid portion 51 is connected to the upper wall of the housing 35 at a position near a front end part via a hinge 58 and includes a main body 52 for closing the opening 36A and a tubular cover 55 to be externally fitted on the front end part of the housing 35.

A rubber plug mounting portion 53 projects in the main body 52 and a rubber plug 54 is externally fitted on this rubber plug mounting portion 53.

The rubber plug 54 is fitted to the inner surface of the tubular peripheral wall 36 by mounting the lid portion 51. This causes the inner surface of the tubular peripheral wall 36 and the outer surface of the rubber plug 54 to be held in close contact, thereby sealing the lid portion 51 and the housing 35 in a watertight manner.

Figure 5:
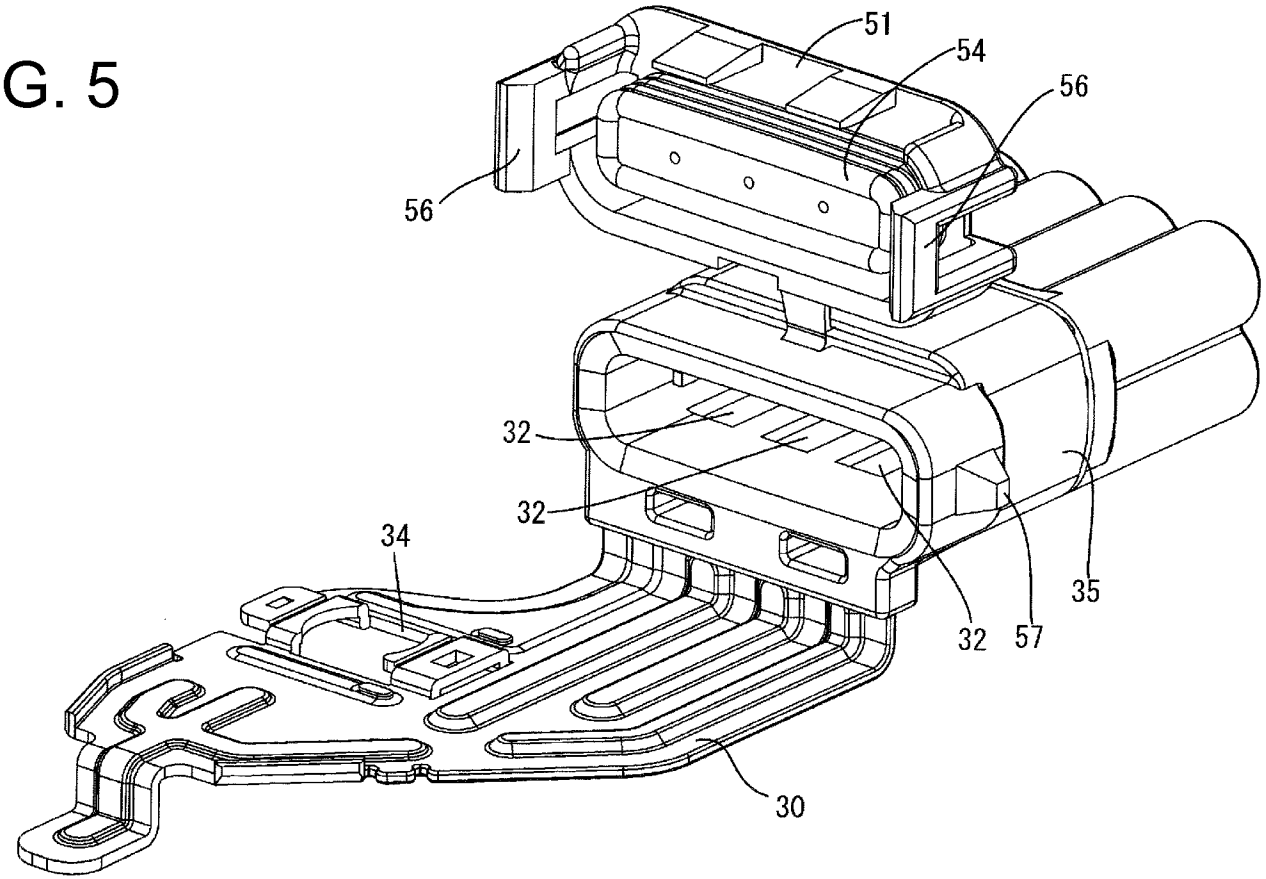
FIG. 5 is a perspective view showing the joint connector in a state where the lid portion is opened before terminal fittings are mounted.

As shown in FIG. 5, frame-like lock portions 56 are provided on left and right sides of the tubular cover 55 and locked to lock receiving portions 57 formed to project from the outer side surfaces of the housing 35, thereby locking the lid portion 51.

Next, how to assemble the joint connector 10 is described.

After the conductive member 30 is punched out and bent by a press machine, it is fixed in a mold and insert molding is performed. Subsequently, the terminal fittings 20 connected to the ends of the ground wires W are inserted into the accommodating chambers 37 from behind the housing 35. The terminal fittings 20 are inserted to be mounted at different timings at least for pairs of upper and lower accommodating chambers 37. When the terminal fitting 20 is inserted to a position where it comes into contact with the locking lance 43, the locking lance 43 is resiliently deflected. When the terminal fitting 20 is further pushed, the locking projection 43A of the locking lance 43 reaches the interior of the locked hole 23 of the terminal connecting portion 21, the locking lance 43 is restored and the locking projection 43A is arranged in the locked hole 23. Since this causes the locking projection 43A to be locked to the hole edge of the locked hole 23 even if the terminal fitting 20 is pulled backward, the terminal fitting 20 is retained.

In this way, all the terminal fittings 20 are mounted into the housing 35.

Here, normally, the locking projection 43A of the locking lance 43 is arranged in the locked hole 23 of the terminal connecting portion 21 when the terminal fitting 20 is inserted. Since a trouble in which, for example, the terminal fitting 20 is not inserted up to a predetermined position, the locking lance 43 is left resiliently deflected and the locking projection 43A is not arranged in the locked hole 23 can also be supposed, a state of the locking lance 43 is inspected.

To inspect the state of the locking lances 43, the plate-like inspection member T is inserted through the front opening 36A of the housing 35 and pushed backward with the lateral edge parts thereof inserted into the groove portions 48 of the guide portions 46. Then, the inspection member T reaches the deflection permitting spaces 44 between the pairs of locking lances 43, 43 (since there is no obstacle such as partition walls on the way).

At this time, if the locking projections 43A of the locking lances 43 are arranged in the locked holes 23 of the terminal connecting portions 21, the locking lances 43 are normally restored after being resiliently deflected. Thus, the inspection member T can be inserted up to a position where it comes into contact with the base end sides of the pairs of the locking lances 43, 43.

On the other hand, if the locking projections 43A of the locking lances 43, 43 are not arranged in the locked holes 23, the locking lances 43 are not normally restored after being resiliently deflected. Thus, the inspection member T cannot be inserted up to the position where it comes into contact with the base end sides of the pairs of the locking lances 43, 43. In this way, whether or not the terminal fittings 20 are inserted at proper positions is inspected by the inspection member T.

The above inspection is made at once by the plate-like inspection member T for the locking lances 43, 43 in all the four columns after all the terminal fittings 20 are mounted into the housing 35. After this inspection, the inspection member T is removed and the lid portion 51 is closed and locked. Then, the bolt is inserted through the mounting hole 34 of the mounting portion 33 to fix the mounting portion 33 to the vehicle body. In this way, the plurality of ground wires W are grounded to the vehicle body via the joint connector 10.

According to the above embodiment, the following functions and effects are achieved.

(1) The joint connector 10 for electrically connecting a plurality of terminal fittings mounted on ends of a plurality of ground wires W (wires) of a vehicle includes a pair of terminal holding portions 49A, 49A for holding a pair of terminal fittings 20, 20, and a pair of locking lances 43, 43 deflectable with respect to each other and configured to suppress the withdrawal of the pair of terminal fittings 20, 20 by locking the pair of terminal fittings 20, 20 are arranged back to back with each other via the deflection permitting space 44 between the pair of terminal holding portions 49A, 49A.

According to this embodiment, since it is not necessary to secure an individual deflection permitting space 44 corresponding to the amount of deflection of each locking lance 43 by arranging the pair of locking lances 43, 43 back to back with each other via the deflection permitting space 44, the deflection permitting space 44 required as a whole can be reduced. Thus, the joint connector 10 can be miniaturized.

(2) The vertical communication space 45 (communication space) is formed to allow communication between the spaces in the pair of terminal holding portions 49A, 49A.

According to this arrangement, since the vertical communication space 45 is formed to allow communication between the spaces in the pair of terminal holding portions 49A, 49A, the configuration of the joint connector 10 can be simplified as compared with the case where the pair of terminal holding portions 49A, 49A are divided by providing a partition wall or the like in the vertical communication space 45.

(3) The vertical communication space 45 (communication space) is provided in projecting directions of the pair of locking lances 43, 43.

According to this arrangement, the configuration in the projecting directions of the pair of locking lances 43, 43 can be simplified.

(4) The vertical communication space 45 (communication space) communicates with the deflection permitting space 44.

According to this arrangement, the configuration of the joint connector 10 can be simplified as compared with the case where the vertical communication space 45 and the deflection permitting space 44 are divided by a partition wall or the like.

(5) The inspection member T for inspecting the locking state of the locking lances 43, 43 is insertable into the vertical communication space 45 (communication spaces) and the deflection permitting space 44.

According to this arrangement, the locking state of the locking lances 43, 43 can be inspected by inserting the inspection member T into the vertical communication space 45 and the deflection permitting space 44.

(6) A plurality of holding portion pairs 49 each composed of the pair of terminal holding portions 49A, 49A are arranged in parallel, and the lateral communication space 42 (communication space) for allowing communication between adjacent deflection permitting spaces 44 is provided between adjacent ones of the plurality of holding portion pairs 49 arranged in parallel.

According to this arrangement, since the lateral communication space 42 (communication space) for allowing communication between the adjacent deflection permitting spaces 44 is provided, the configuration of the joint connector 10 can be simplified as compared with the case where a partition wall is provided between the adjacent deflection permitting spaces 44.

(7) The pair of locking lances 43, 43 are provided in the housing 35 made of synthetic resin, and the housing 35 includes the opening 36A through which the inspection member T for inspecting the locking state of the pair of locking lances 43, 43 is insertable and the inspection member insertion space 59 extending from the opening 36A to communicate with the deflection permitting space 44 and the lateral communication space 42 (communication space).

According to this arrangement, the locking state of the pair of locking lances 43, 43 can be inspected by inserting the inspection member T from the opening 36A of the housing 35 up to the deflection permitting space 44 and the lateral communication space 42 (communication space) through the inspection member insertion space 59.

(8) The lateral communication space 42 (communication space) is provided between adjacent ones of all the holding portion pairs 49.

According to this arrangement, the locking state of the locking lances 43, 43 can be inspected at once for all the terminal fittings 20 by using the inspection member T insertable into all the deflection permitting spaces 44 and lateral communication spaces 42 (communication spaces).

(9) Guide portions 46 are provided to guide the lateral edge parts of the inspection member T extending in an inserting direction.

According to this arrangement, the inspection member T used to inspect the locking state of the locking lances 43, 43 can be easily inserted up to the predetermined position.

(10) The pair of locking lances 43, 43 are provided in the housing 35, and the breaking groove 35A for breaking the housing 35 is provided on the outer peripheral surface of the housing 35.

According to this arrangement, the housing 35 can be easily broken by the presence of the breaking groove 35A such as when the ground wires W are removed. Further, by providing the breaking groove 35A in the configuration in which the lateral communication space 42 (communication space) is provided in the housing 35 as in this embodiment, a breaking operation at the breaking groove 35A can be easily performed due to fewer partition walls.

(11) In the joint connector 10, the wires are ground wires W and the conductive member 30 electrically connected to a plurality of terminal fittings 20 is mounted on and grounded to the vehicle body.

According to this arrangement, even if the communication space 45 allowing communication between the spaces in the pair of terminal holding portions 49A, 49A is provided, it is not necessary to consider dielectric breakdown and the like between the terminal fittings 20 of the ground wires W since no voltage is applied. Thus, this arrangement is preferable as an embodiment of the invention.

The present invention is not limited to the above described and illustrated embodiment. For example, the following embodiments are also included in the technical scope of the present invention.

(1) Although eight terminal fittings 20 connected to eight ground wires W are grounded in the above embodiment, there is no limitation to this and two to seven, nine or more terminal fittings 20 connected to two to seven, nine or more ground wires W may be grounded.

(2) Although the joint connector 10 has a waterproof structure in the above embodiment, there is no limitation to this and the present invention may also be applied to a joint connector having no waterproof structure.

(3) Although the terminal fittings 20 are females terminal fittings in the above embodiment, there is no limitation to this and male terminal fittings may be used. Further, instead of the male tabs 32, female terminals may be used for the conductive member 30.

(4) Although a part of the conductive member 30 is insert-molded with the housing 35 in the above embodiment, there is no limitation to this and, for example, the conductive member 30 may be formed separately from the housing 35 and assembled with the housing 35.

(5) Although the locking lances 43, 43 extend forward in the above embodiment, there is no limitation to this and locking lances may extend backward. In this case, deflection permitting spaces for the locking lances are formed on the rear side.

(6) Although the partition walls are provided to surround the ground wires W over the entire circumferences in the wire accommodating portions 38 in the above embodiment, there is no limitation to this and no partition walls may be provided in parts of the wire accommodating portions 38 as in the terminal accommodating portions 40.

(7) Although the deflection permitting space 44 and the lateral communication space 42 are provided for each of all the pairs of terminal holding portions 49A, 49A (between adjacent ones of all the holding portion pairs 49) in the above embodiment, there is no limitation to this and the deflection permitting space 44 and the lateral communication space 42 may be provided between some pairs of adjacent holding portion pairs 49.

(8) Although the locking lances 43, 43 cantilevered from one end side connected to the bottom wall 41 are used in the above embodiment, there is no limitation to this and locking lances (locking portions) connected to the bottom walls on both end sides (or connected to the bottom wall on one end and connected to each other to form a ring shape on the other end), i.e. supported on both ends may be arranged back to back. Note that since the inspection member T cannot be inserted in an extending direction of the locking lances in this case, it may be configured to be insertable between the pair of locking lances, for example, in a connecting direction of the deflection permitting space 44 and the lateral communication space 42, which is a direction perpendicular to the extending direction of the locking lances.

The invention claimed is:

1. A joint connector for electrically connecting a plurality of terminal fittings mounted on ends of a plurality of wires of a vehicle, comprising:

a housing having opposite front and rear ends and a plurality of pairs of terminal accommodating chambers extending through the housing from the rear end to the front end, the terminal accommodating chambers in each of the pairs being opposed to one another and the pairs of terminal accommodating chambers being arranged side by side to define two rows of terminal accommodating chambers, each of the terminal accommodating chambers being configured for holding one of the terminal fittings;

a conductive member having a U-shaped tab coupling portion insert molded into the front end of the housing, tabs extending from the tab coupling portion and projecting into the respective terminal accommodating chambers for contacting the terminal fittings held therein, and a mounting portion extending from the tab coupling portion to a location external of the front end of the housing, the mounting portion being configured for mounting to and grounded by a body of the vehicle;

pairs of locking lances cantilevered forward in the housing and disposed so that the locking lances in each of the pairs of locking lances project partly into the terminal accommodating chambers in each of the pairs of terminal accommodating chambers, the locking lances being deflectable with respect to each other and configured to suppress withdrawal of the terminal fittings by locking the terminal fittings, the locking lances in each of the pairs of locking lances being arranged back to back with each other and on opposite sides of a forwardly open deflection permitting space between the terminal accommodating chambers in each of the pairs of terminal accommodating chambers; and forwardly open lateral communication spaces between the deflection permitting spaces.

2. The joint connector of claim 1, wherein the communication spaces extend from the front end of the housing to locations in the housing from which the locking lances are cantilevered.

3. The joint connector of claim 1, further comprising an inspection member for inspecting a locking state of the locking lances, the inspection member being insertable into the communication spaces and the deflection permitting spaces.

4. The joint connector of claim 1, wherein:

the terminal accommodating chambers in each of the pairs of terminal accommodating chambers are arranged in parallel.

5. The joint connector of claim 1, further comprising a guide portion formed in the housing and configured to guide a lateral edge part of the inspection member extending in an inserting direction.

6. The joint connector of claim 1, further comprising forwardly open inter-chamber communication spaces between the locking lances that are laterally adjacent to one another.

7. The joint connector of claim 1, wherein a dimension of each of the deflection permitting spaces in a direction parallel to a deflection direction of the respective locking lances being sufficiently large to permit one of the locking lances in the respective pair of locking lances to be deflected sufficiently for one of the terminal fittings to be inserted into or removed from the corresponding terminal accommodating chamber, but being too small to permit both of the locking lances to be simultaneously inserted into or removed from the terminal accommodating chambers of the respective pair.

8. A joint connector for electrically connecting a plurality of terminal fittings mounted on ends of a plurality of wires of a vehicle, comprising:

a housing having opposite front and rear ends and a plurality of pairs of terminal accommodating chambers extending through the housing from the rear end to the front end, the terminal accommodating chambers in each of the pairs being opposed to one another and the pairs of terminal accommodating chambers being arranged side by side, each of the terminal accommodating chambers being configured for holding one of the terminal fittings;

pairs of locking lances cantilevered forward in the housing and disposed so that the locking lances in each of the pairs of locking lances project partly into the terminal accommodating chambers in each of the pairs of terminal accommodating chambers, the locking lances being deflectable with respect to each other and configured to suppress withdrawal of the terminal fittings by locking the terminal fittings, the locking lances in each of the pairs of locking lances being arranged back to back with each other and on opposite sides of a forwardly open deflection permitting space between the terminal accommodating chambers in each of the pairs of terminal accommodating chambers;

forwardly open lateral communication spaces being between the deflection permitting spaces; and a breaking groove provided on an outer peripheral surface of the housing and extending circumferentially around the outer peripheral surface of the housing in a direction transverse to a direction extending from the front end to the rear end to permit breaking of the housing for removing the terminal fittings and the wires connected thereto.

9. The joint connector of claim 8, wherein the wires are ground wires and a conductive member electrically connected to the plurality of terminal fittings is mounted on and grounded to a vehicle body.

10. The joint connector of claim 8, wherein the breaking groove is at a position in a front-back direction substantially aligned with rear end parts of the deflection permitting spaces and with the lateral communication spaces between the deflection permitting spaces.

11. A joint connector for electrically connecting a plurality of terminal fittings mounted on ends of a plurality of wires of a vehicle, comprising:

a housing having opposite front and rear ends and a plurality of pairs of terminal accommodating chambers extending through the housing from the rear end to the front end, the terminal accommodating chambers in each of the pairs being opposed to one another and the pairs of terminal accommodating chambers being arranged side by side, each of the terminal accommodating chambers being configured for holding one of the terminal fittings;

pairs of locking lances cantilevered forward in the housing and disposed so that the locking lances in each of the pairs of locking lances project partly into the terminal accommodating chambers in each of the pairs of terminal accommodating chambers, the locking lances being deflectable with respect to each other and configured to suppress withdrawal of the terminal fittings by locking the terminal fittings, the locking lances in each of the pairs of locking lances being arranged back to back with each other and on opposite sides of a forwardly open deflection permitting space between the terminal accommodating chambers in each of the pairs of terminal accommodating chambers, a dimension of each of the deflection permitting spaces in a direction parallel to a deflection direction of the respective locking lances being sufficiently large to permit one of the locking lances in the respective pair of locking lances to be deflected sufficiently for one of the terminal fittings to be inserted into or removed from the corresponding terminal accommodating chamber, but being too small to permit both of the locking lances to be simultaneously inserted into or removed from the terminal accommodating chambers of the respective pair; and forwardly open lateral communication spaces between the deflection permitting spaces.

* * * * *